United States Patent [19]

Muzslay

[11] Patent Number: 4,618,196

[45] Date of Patent: Oct. 21, 1986

[54] GENDER REVERSAL CONNECTOR

[75] Inventor: Steven Z. Muzslay, Huntington Beach, Calif.

[73] Assignee: ITT Corporation, New York, N.Y.

[21] Appl. No.: 739,398

[22] Filed: May 30, 1985

[51] Int. Cl.[4] ..... H01R 31/06

[52] U.S. Cl. ..... 339/17 C; 339/156 R

[58] Field of Search ..... 339/17 R, 17 C, 14 R, 339/143 R, 147 R, 154 R, 154 A, 156 R, 157 R

[56] References Cited

U.S. PATENT DOCUMENTS

| | | | |
|---|---|---|---|
| 3,413,594 | 11/1968 | Fernald et al. | 339/176 MP |
| 3,551,874 | 12/1970 | Volinskie | 339/17 R |
| 3,737,833 | 6/1973 | Jerominek | 339/156 R |
| 3,850,500 | 11/1974 | Cobaugh et al. | 339/258 R |
| 3,865,454 | 2/1975 | Blinder | 339/17 C |
| 3,963,300 | 6/1976 | Patton et al. | 339/156 R |
| 4,148,543 | 4/1979 | Shore | 339/143 R |
| 4,227,764 | 10/1980 | Fiske | 339/156 R |
| 4,457,576 | 7/1984 | Cosmos et al. | 339/143 R |
| 4,519,665 | 5/1985 | Althouse et al. | 339/143 R |

FOREIGN PATENT DOCUMENTS

| | | | |
|---|---|---|---|
| 2823465 | 5/1978 | Fed. Rep. of Germany . | |
| 83/00456 | 10/1983 | PCT Int'l Appl. | 339/17 C |

*Primary Examiner*—Neil Abrams

*Attorney, Agent, or Firm*—T. L. Peterson; R. C. Turner

[57] ABSTRACT

A connector is described, of a type which has contacts at opposite ends that are of the same gender (male plug or female receptacle) and with each end having contacts arranged in the same pattern with respect to the key at that end, wherein the connector is of simple and low cost construction. The connector includes a plate of insulative material having a row of conductive traces thereon, each trace having upper and lower holes. Two corresponding pin contacts have inner ends received in different holes of the same trace, with the outer end of one pin projecting into a first end of the connector and the outer end of the other pin projecting into the second end of the connector. A key in the form of a shell with wide and narrow sides, is oriented at one end of the contact with its wide side uppermost and is oriented at the other end of the connector with its wide side lowermost.

6 Claims, 11 Drawing Figures

50
PIN 13a
52
78
73a
74
54
PIN 25a
70a
66a
58
62
PIN 14a
71a
124
86
76
51
90
PIN 1a
PIN 3a
60
64a
68a
56
72
PIN 1b
PIN 14b
71b
70b
PIN 3b
66b
73b
PIN 13b
64b
68b
84
13a
116
118
68b
13b
PIN 25a
PIN 25b
92
122
PIN 2a
114
14b
PIN 14b
PIN 2b
4
4
PIN 1a
PIN 1b
111
112
13
25
14

FIG. 6
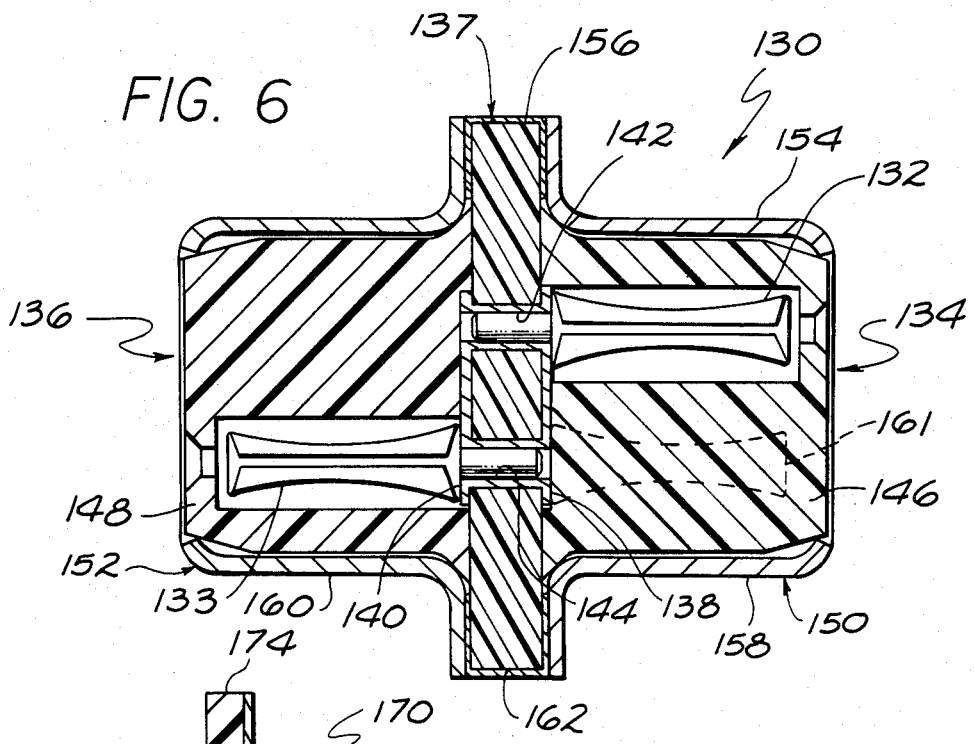
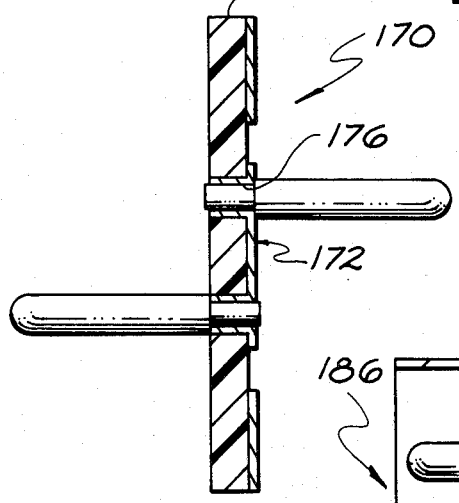
FIG. 7
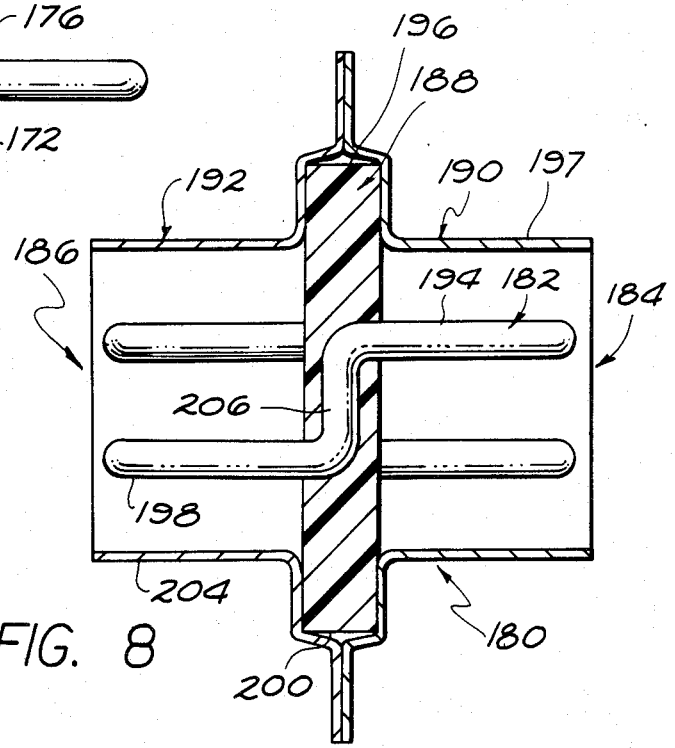
FIG. 8

GENDER REVERSAL CONNECTOR

BACKGROUND OF THE INVENTION

Situations sometimes occur where it is necessary to interconnect the end of a connector on an apparatus to the end of a connector on a cable, where both connector ends have the same gender: that is, where both are a male or pin type end or both are a female or socket type end. A gender reversal coupling, which has a male arrangment at both ends or a female arrangement at both ends is required to interconnect the two connectors.

In a common connector with opposite genders at its ends, the pattern of contacts at the opposite ends are mirror images of each other. In such a connector, a contact at one end of the connector which lies at one side of the housing, must be connected to a contact at the other end, which lies at the same side of the housing. A simple conductor which extends in a straight line between the male and female contacts, both designated number 1, will interconnect them.

In a prior gender reversal connector, a contact at one end of the connector which lies at one side of the housing, must be connected to a pin at the other end which lies adjacent to the opposite side of the housing. Simple conductors could not be used, since they would pass across one another. In the prior art, a gender reversal connector has been constructed by the use of a printed circuit board which was used to form circuitous paths to connect pins at opposite corners of the connector. This resulted in a considerable cost for the connector, and a reduced reliability because of the multiple connections required between the printed circuit board and the projecting contacts at the opposite ends of the connector; it also raised the possibility that a long overhanging connector might damage a mating connector that is rigidily attached to an electronic device. A gender reversal connector which could produce the same pattern at both ends of a connector (both male or female patterns) and which was of simple and compact construction would be of considerable value.

SUMMARY OF THE INVENTION

In accordance with one embodiment of the present invention, a gender reversal connector is provided which is of compact and simple design. The conector has a middle portion and has opposite ends which have identical keys that are oriented upsidedown with respect to one another, so that if the connector is rotated 180° about a laterally-extending axis extending along its middle portion, then the keys will have identical orientations. The connector includes an insulative plate with two rows of plated holes, and has conductive traces for connecting pairs of holes that lie in different rows. Each trace connects one contact which has an inner end lying in a hole and which projects from one face of the plate, to a second contact whose inner end lies in another hole of another row and which projects from an opposite face of the plate. The peripheries of the two faces of the plate are plated with metal and are connected by a plated edge of the plate. Each metal shell is in facewise contact with the plated periphery of a corresponding face of the plate.

The novel features of the invention are set forth with particularity in the appended claims. The invention will be best understood from the following description when read in conjunction with the accompanying drawings.

BRIEF DESCRIPTION OF THE DRAWINGS

FIG. 6 is a sectional view of a gender reversal connector of another embodiment of the invention wherein both ends are female.

FIG. 7 is a sectional view of a gender reversal connector of another embodiment of the invention.

FIG. 8 is a sectional view of a gender reversal connector of another embodiment of the invention.

DESCRIPTION OF THE PREFERRED EMBODIMENTS

Figures 1, 4:
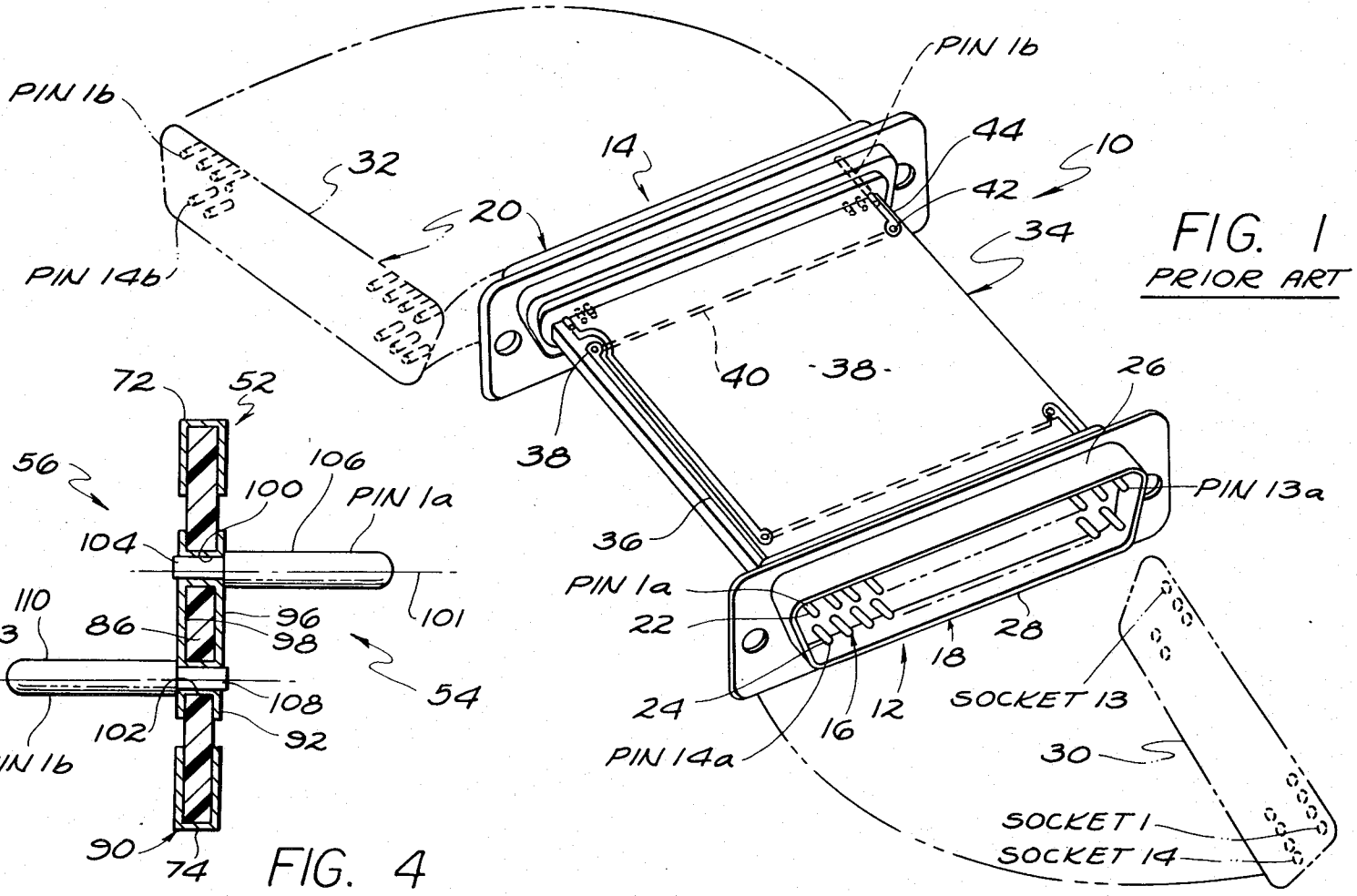
FIG. 1 PRIOR ART
FIG. 1 is a perspective view of a gender reversal connector constructed in accordance with the prior art, with the hidden end of the connector shown by an image in phantom lines.
FIG. 4 is a view taken on the line 4—4 of FIG. 3.

FIG. 1 illustrates a prior art gender reversal connector 10, which has opposite ends 12, 14 that have identical patterns of contacts 16 arranged with respect to their keys which are in the form of identical keyed shells 18, 20. In this connector, the contacts or pins 16 are arranged in two rows which may be referred to as the first or wide row 22 and the second or narrow row 24. Each shell such as 18 is in the form of a "D" shaped key with a first or wider side 26 and a second or narrower side 28. The first row 22 of pins has one pin more than the second row 24, and the first row 22 lies closest to the first side 26 of the shell. In this particular connector arrangement there are twenty-five pins with thirteen in the first row and twelve staggered pins in the second row. The pins are numbered 1 through 25, with the pins at the first end of the connector labeled "a" and corresponding pins on the opposite end labeled "b". When the connector end 12 is to be connected to a female connector end indicated at 30, the male pin 1*a* connects to a female socket 1. Similarly, the top and rightmost male pin 13*a* connects to a top and leftmost socket 13. It can be seen that the male and female connector ends are mirror images of each other. In a design whrein the pins number "1" carry current for powering a device, it is necessary that pin 1*a* connects to socket 1 of the female connector.

In the prior art gender reversal coupling shown in FIG. 1, the second end 14 of the connector is shown in phantom lines and rotated so that it can be seen from a position beyond the second end of the connector. It can be seen that the second keyed shell 20 at the second end of the connector has a wide side 32 that is uppermost and that pin 1*b* at the second end is located at the upper leftmost portion of the second end. Since the pin 1*b* must carry the same current as pin 1*a* at the opposite end, the prior art connector included a circuit board 34. The circuit board included a conductor 36 on the top face 38 of the board which connected to pin 1*a* and which extended to a hole 38. The plated-through hole extended to another conductor 40 on the lower face of the circuit board to another plated-through hole 42. Another conductor 44 extending from the hole 42 was connected to the pin 1*b*. Other connections between corresponding pins at the opposite ends of the connector required similar complicated conductors on the circuit board 34. This resulted in a gender reversal connector 10 of relatively high cost and complexity and considerable size. One disadvantage is that when one end such as 12 was connected to a circuit board, and the other end 14 was connected to a cabled connector, the long distance between the opposite ends 12, 14 resulted in a long overhang of the connector. This raised the possibility that a moderate downward or upward force applied to the second end 14 could damage the mating connector because of the long leverage arm between the opposite ends 12, 14.

Figures 2, 3:
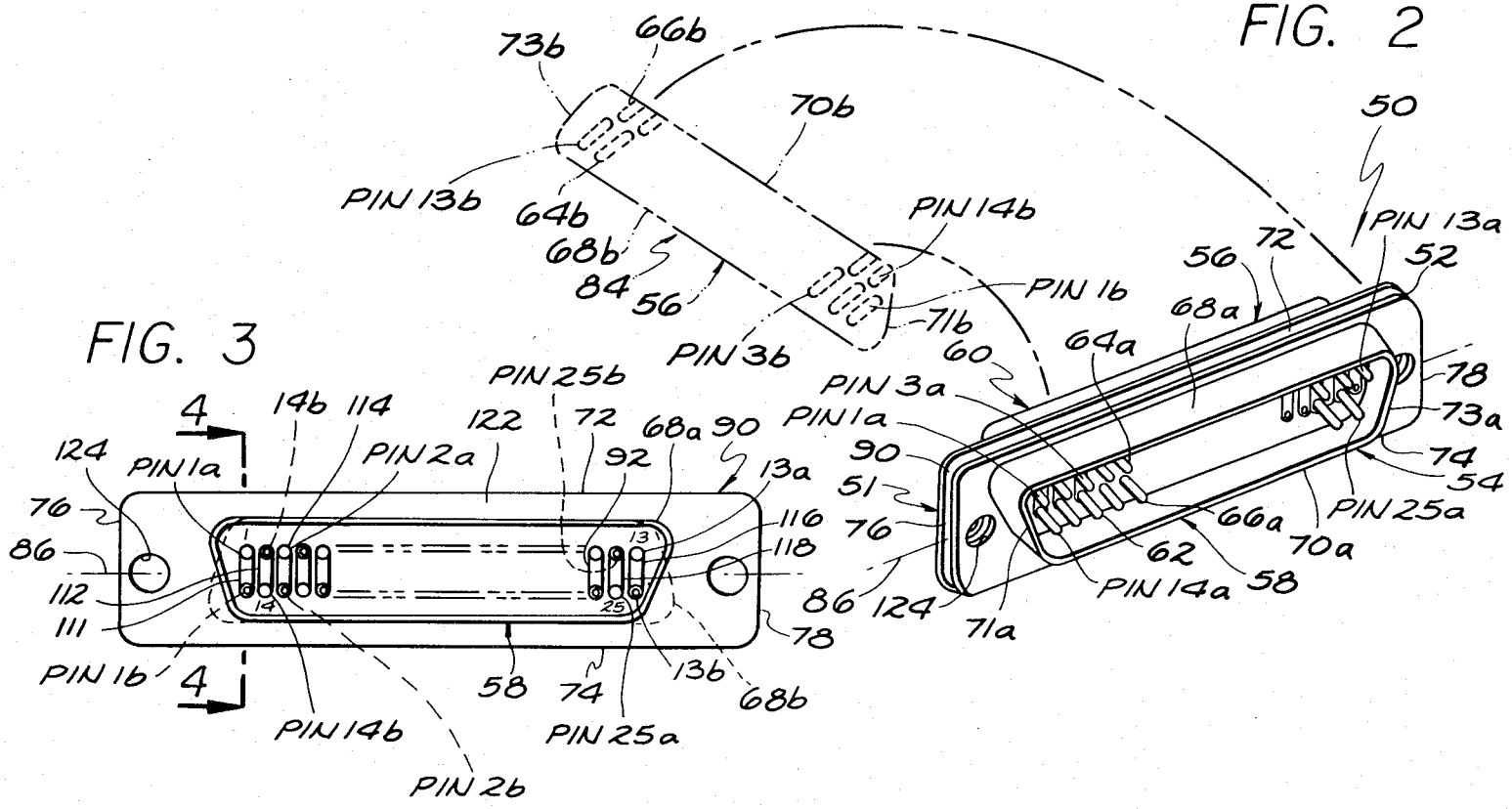
FIG. 2 is a perspective view of a gender reversal connector constructed in accordance with the present invention, with the hidden end of the connector shown by an image in phantom lines.
FIG. 3 is a front elevation view of a plate of the connector of FIG. 2.

FIG. 2 illustrates a connector 50 of the present invention which has a housing 51 with a middle 52 and opposite ends 54, 56. The ends of the connector include identical keys in the form of shells 58, 60 for defining the orientation of the end, and a plurality of contacts 62. In this embodiment of the invention, both ends of the connector have male or plug contacts in the form of pins. The pins at each end are arranged in two rows including a first wide row 64*a* or 64*b* and a second narrow row 66*a* or 66*b*. The first wide row 64*a* is closest to the wide side 68*a* of the key, while the lower row 66*a* is closest to the narrow side 70*a* of the key. The shell also has angled sides 71*a*, 73*a*. A similar arrangement exists at the opposite end of the connector. The middle portion 52 of the connector has top and bottom portions or edges 72, 74 and opposite side edges 76, 78. Each shell defines an orientation of a corresponding connector end; for example, when the wide end 68*a* of a shell is uppermost, it may sometimes be said that the connector end is "upright" and the first row 64*a* is the "upper" row.

In accordance with the present invention, the angled sides of the shells 58, 60 at opposite ends of the connector are oriented upside down from one another. That is, while the shell 58 at the first end 54 of the connector is located with its wide side 68*a* uppermost in the figure and closest to the top edge 72 of the middle, the shell 60 at the second end 56 of the connector has its wide side 68*b* lowermost in the figure and closest to the bottom edge 74 of the middle of the connector. Thus, if the connector were rotated 180° about a lateral axis 86 extending through the middle of the connector between its opposite side edges 76, 78, the two shells 54, 56 would have identical orientations.

While the first or wide row of pins 64*a* at the first end of the connector is closest to the top edge 72 of the connector middle, the first or wide row 64*b* at the second end of the connector is closest to the bottom edge 74 of the connector middle. As a result, the upper and leftmost pin 1*a* at one end of the connector, and the corresponding pin 1*b* at the opposite end of the connector, both lie closest to the same side edge 76 of the connector. These two pins, pin 1a and pin 1*b* can be connected by a conductor that extends a short distance vertically (in a direction between the vertically-spaced edges 72, 74 of the connector middle). Both pins 1*a* and 1*b* have the same relative locations with respect to their keyed shells, because when the wide side 68*a* of shell 58 is uppermost, pin 1*a* is the upper and leftmost pin at the connector end 54; when the wide side 68*b* of shell 60 is uppermost, pin 1*b* is the upper and leftmost pin at its connector end 56.

FIG. 4 illustrates a manner in which pin 1*a* and pin 1*b* are connected together. The middle portion 52 of the connector includes a plate 90 of insulative material which has two rows of plated-through holes 100, 102. The holes are located on imaginary planes 101, 103. The connector also has a row of conductive traces 92 formed by plated trace layers 96, 98 on opposite faces of the plate. The pin 1a has an inner end 104 tightly held within the plated hole 100, and has an outer end 106 which projects into the first end 54 of the connector. The other pin 1*b* is similarly constructed, with an inner end 108 held within a plated hole 102 and an outer end 110 projecting into the second end 56 of the connector. It can be seen that the two pins 1*a* and 1*b* are connected together in a simple manner, which enables the pin 1*a* nearest the top edge 72 of the connector to be connected to the pin 1*b* which is closest to the bottom edge 74 of the connector.

Figure 5:
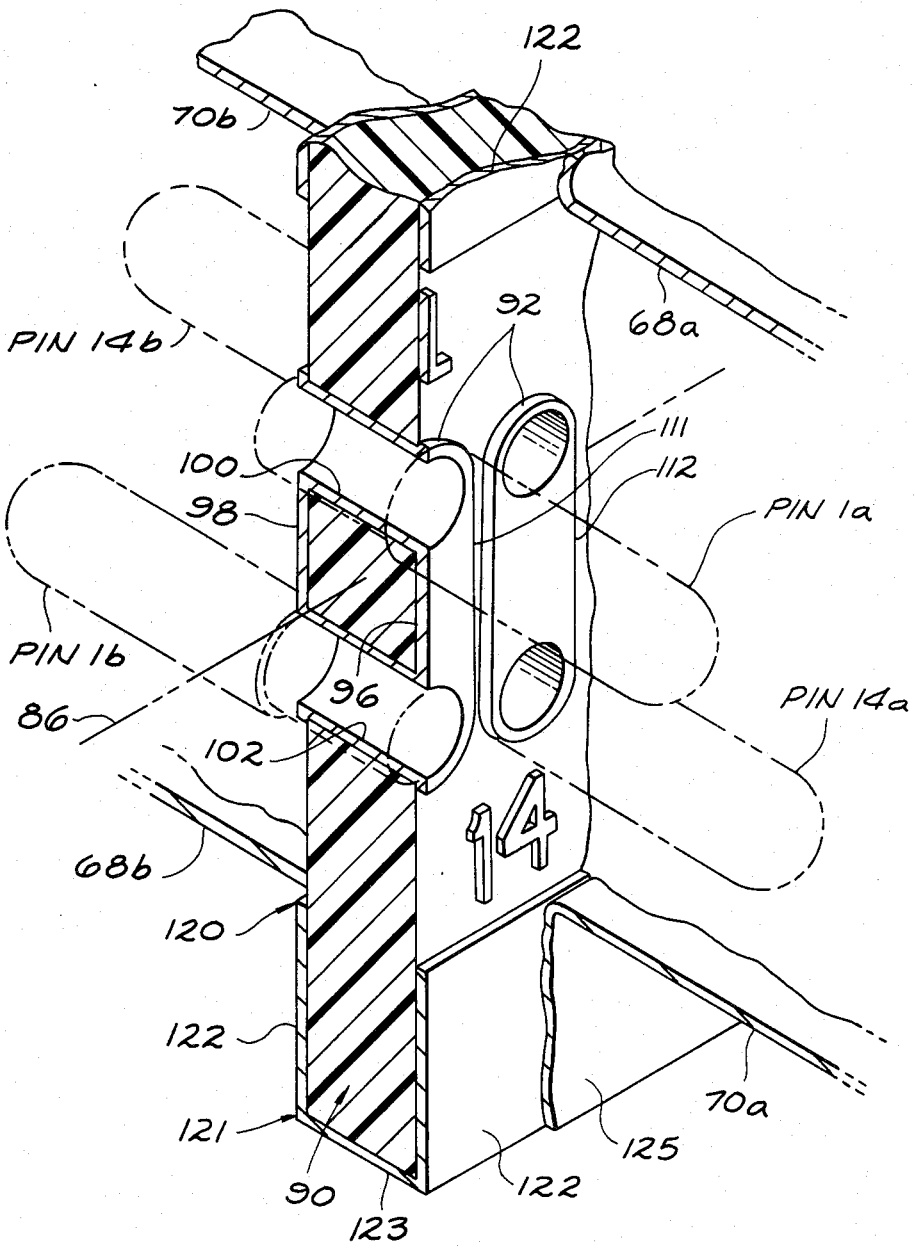
FIG. 5 is an enlarged perspective view of a portion of the plate of FIG. 3.

FIGS. 3 and 5 show some details of the center plate 90 of the connector and of the traces 92 thereon. For a connector that has twenty-five pins, arranged in a first wide row containing thirteen pins and a second narrow row containing twelve pins, the connector includes a row of twenty-five traces 92 spaced along the lateral axis 86 of the connector. The first trace 111 connects pin 1*a* in the uppermost row to pin 1*b* at the opposite end of the connector. The next trace 112 which is adjacent to the first one, can be considered to be the fourteenth trace, in that is connects a pin 14*a* of the second narrow row to a corresponding pin 14*b* at the opposite end of the connector. The next tract 114 (FIG. 3) may be considered the second trace, in that it connects pin 2*a* to a corresponding pin 2*b* at the opposite end of the connector. The last trace 116 connects a pin 13*a* to an opposite pin 13*b*. The next to last trace 118 connects pin 25*a* in the lower row to a corresponding pin 25*b* at the opposite end of the connector.

The plating 120 (FIG. 5) on the insulative plate 90 includes a peripheral metal plating layer 121 which includes face portions 122 on each face of the plate. Each face portion extends around the rows of contacts, and the face portions are connected by an edge portion 123 that extends around the entire edge of the plate. Each shell has a peripheral portion 125 that lies in facewise contact with a corresponding face portion 122, to thereby provide a continuous shield against rf radiation that might induce noise in the contacts.

The connector is designed for low cost manufacture. The traces 92 and the plated walls of the holes 100, 102 are formed of a solderable material such as copper, while the contacts can also have solderable surfaces. The contract inner ends are pressed into the holes in interference fit, and where desired the pins are soldered in place by the reflow solder method.

Each face portion 122 of the plating layer has the same outline as the keyed shell attached to the face of the plate. FIG. 3 shows that while the wide side 68*a* of the shell at one end of the connector is nearest the upper edge 72 of the plate, the wide side 68*b* of the shell at the opposite end is closest to the bottom edge 74 of the plate. The keyed shells 58, 60 lie on opposite faces of the middle plate and can be attached to each other through holes 124 in the shells and plate. It also may be noted that the plating layer on each face of the plate forms the numbers "1", "13", "14", and "25" to identify the corresponding pins.

FIG. 6 illustrates another connector 130 which is of the female or socket type, in that it includes rows of sockets 132, 133 at its opposite ends 134, 136 (although the sockets are largely pin shaped). The connector includes a middle in the form of a plate 137 of insulative material, and a pair of plate layers 138, 140 on opposite sides of the plate. A pair of plated-through holes 142, 144 extend between the opposite platings 138, 140. Each socket 132 at one end and its corresponding socket 133 are connected together through the platings. A support 146, 148 of insulative material surrounds the sockets at each end of the connector. Each end of the connector includes two rows of sockets, and includes a key or keyed shell 150, 152 that surrounds the rows of sockets and also the supports 146, 148. The key 150 includes a wide upper side 154 which lies adjacent to a first side 156 of the plate 138 at the middle of the connector. The wide side 154 of the shell is wider than the opposite narrow side 158, to define the socket 132 as lying in an "upper" row, as compared to contacts such as 161 which lie in a "lower" row. The other keyed shell 152 has a widest side 160 closest to the second side 162 of the middle plate 137, to define the socket 133 as lying in the "upper" row for that end 136 of the connector.

FIG. 7 illustrates a portion of another gender reversal connector 170, which is similar to the connector of FIG. 4, except that a plating 172 on the middle plate 174, covers only one face of the plate 174 and the holes 176 therein.

FIG. 8 illustrates another gender reversal connector 180, which includes Z-shaped pins 182 for forming contacts at opposite ends 184, 186 of the connector. Each contact is embedded in a center plate 188 of insulative material, and the opposite ends of the contacts are surrounded by keyed shells 190, 192. The Z shape of the contacts produce one contact 194 lying in a row that is closest to a first side 196 of the center plate and to a wider side 197 of its keyed shell, and another contact 198 that lies closest to an opposite side 200 of the center plate and to the wider side 204 of its keyed shell. The contacts 194, 198 are elongated and extend substantially parallel to each other, and are integral with a middle portion 206 that extends largely perpendicular to the ends.

Figure 9:
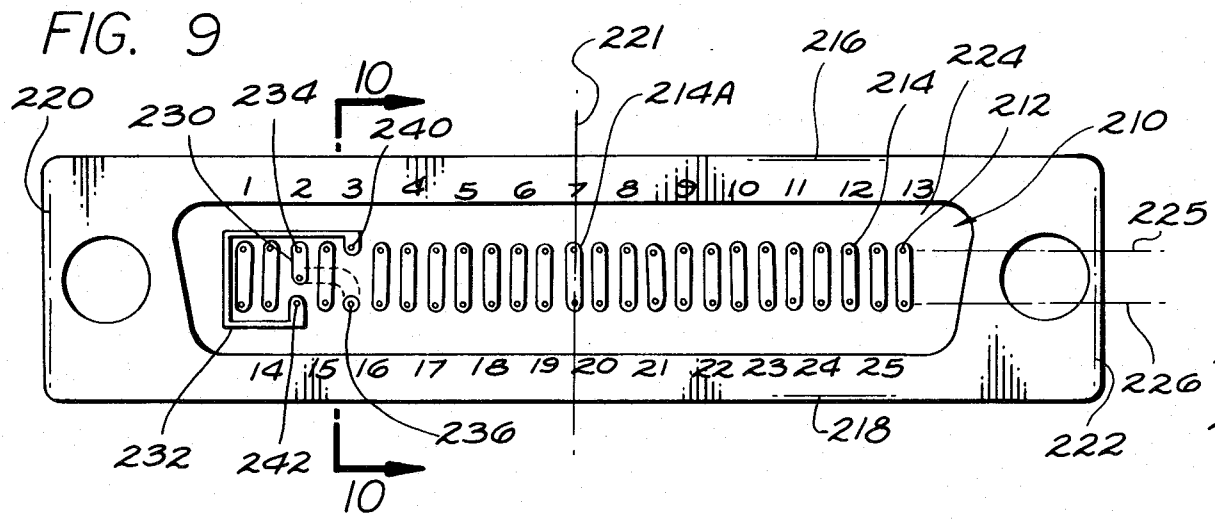
FIGS. 9 and 10 are partial views of another embodiment of the invention.
Figure 10:
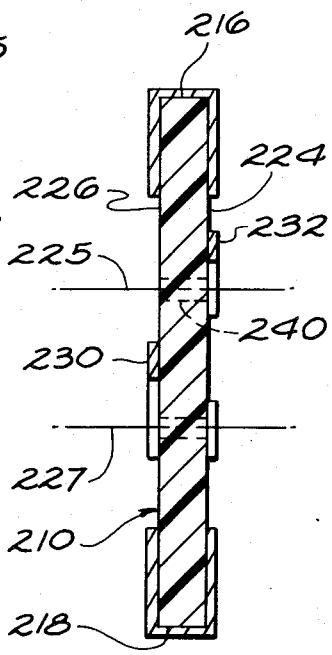

FIGS. 9 and 10 illustrate another connector which has a construction largely similar to that of FIGS. 2 through 5, but wherein the traces are not all parallel. The connector includes a plate 210 of insulative material with multiple plated-through holes 212 and multiple traces 214 for interconnecting selected plated holes. Applicant has written the numbers "1" through "25" above or below each trace, to indicate the pin locations as they are typically designated in the industry. The plate has upper and lower edges 216, 218, opposite sides 220, 222, and opposite faces 224, 226. The plate also has two rows of plated holes lying on planes 225, 227. Unlike the previous embodiments of the invention, not alll traces extend "vertically". Most of the traces are similar to trace 214A which connects two holes which are the same distance from side 220 of the plate and which lie on an imaginary line 221 that extends perpendicular to the top and bottom edges 216, 218 of the plate. Two of the traces 230, 232 are adaptor traces that do not connect holes at the same distance from one side such as 220 of the plate. The trace 230 connects two contact receiving holes 234, 236 to connect a pin contact lying in hole 234 that projects from the face 224 of the plate, to another pin lying in hole 236 which projects from the opposite face 226. The other trace 232 connects two holes 240, 242, to connect a pin in hole 240 that projects from one face 224 of the plate to a pin in the other hole 242 that projects from the opposite face. In this way, signals from location "2" at one end of the connector are connected to a pin at another row "3" at the opposite end of the connector, and vice versa. This arrangement is useful as a "modem" adapter. It can be seen that one of the traces 234 extends in the spaces between the two rows of holes while the other trace 232 extends around the two rows of holes.

Figure 11:
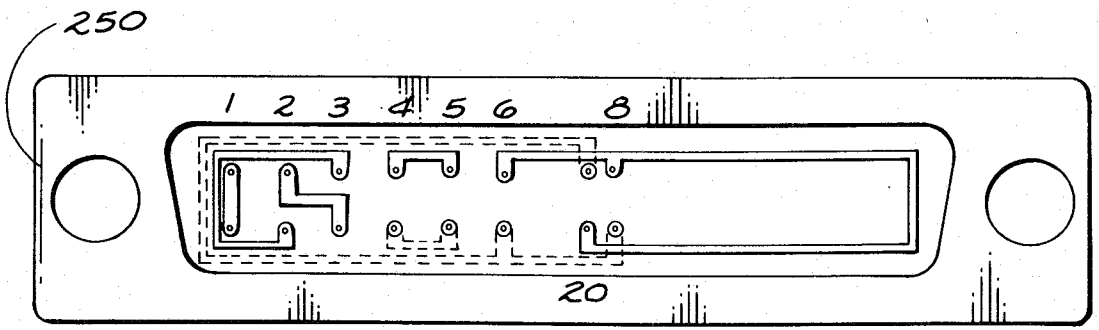
FIG. 11 is a partial view of another embodiment of the invention.

FIG. 11 illustrates another adapter for making interconnections for an adapter known as a "null modem" wherein there is a different interconnection of holes where some pairs of interconnected holes are not equally distant from one edge such as 250 of the connector plate. This connector is constructed somewhat similarly to that of FIG. 9 except that the traces have a different arrangement as shown in Figure 11, and some holes in the same row are interconnected.

More complex interconnections of the pins or sockets of the gender reversal connector can be accomplished by utilizing multilayer printed circuit boards.

Thus, the invention provides a compact reversal coupling or connector. An insulative plate has two tows of holes, arranged in pairs wherein one hole of each pair is in different row but both holes are the same distance from a side of the plate and a contact projects from each hole into a different end of the connector. Keys in the form of shells at the opposite ends of the connector, are oriented 180° from each other. Pairs of plated holes are connected by conductive traces that plate the insulative plate. The plating on the plate includes portions that extend around the periphery of each face of the plate, and a portion on the edge of the plate to connect the peripheral portions.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A gender reversal connector comprising:

a plate of insulative material having first and second opposite faces, top and bottom edges, and opposite sides;

first and second rows of holes in said plate, each row of holes extending parallel to said edges with said first row closer to the top edge and the second row closer to the bottom edge, each hole being plated with conductive material;

a plurality of conductive traces, each connecting a hole in said first row to a hole in said second row;

a plurality of elongated contacts, each including an inner end lying in one of said holes and an outer end projecting away from a face of said plate, said contacts of each pair having inner ends lying in different holes whose platings are connected by a trace and with each contact of a pair extending away from a different face of the plate;

most of the contacts whose inner ends lie in a first row of holes positioned so every other contact extends from said first face of said plate and the contacts inbetween extend from said second face of said plate, and most of the contacts whose inner ends lie in said second row of holes are positioned so every other contact extends from said second face of said plate and the contacts inbetween extend from said first face of said plate, said contacts being so arranged that a first connector can be electrically joined to the rows of contacts at one face and another connector basically similar to the first connector but rotated substantially 180° thereto can be electrically joined to the rows of contacts at the other face.

2. The connector described in claim 1 wherein:

said two rows of plated holes are arranged in pairs, with both holes of a pair lying on a corresponding imaginary line extending substantially perpendicular to said top and bottom edges, as seen when facing a face of the plate;

most of said traces extend parallel to a corresponding one of said lines to connect the walls of the pair of plated holes that lie on the same one of said lines;

at least two of said traces being adaptor traces each adaptor trace includes a transverse trace portion extendign largely perpendiclar to said lines, one adaptor trace connecting a hole in said first row which lies on a first of said lines to a hole in said second row which lies on a second of said lines, and the other adaptor trace connecting a hole in said second row which lies on said first line to a hole in said first row which lies on said second line.

3. The connector described in claim 2 wherein:

the transverse trace portion of said first adaptor trace lies within a region bounded by said two rows of holes, while the transverse trace portion of said second adaptor trace lies outside said region bounded by said two rows of holes.

4. A gender reversal connector comprising:

a housing having a middle and first and second opposite ends, said housing forming two substantially identical shells with one shell at each end, and said housing forming top and bottom edges at said middle and forming opposite housing sides connected by a first imaginary line;

a plurality of contacts projecting from said middle and into each end of the housing, said contacts being arranged in pairs wherein both contacts of the pair have the same gender, with a first contact of a pair projecting into said first end of said housing and a second contact of a pair projecting into the second end of the housing with both contacts of a pair being largely the same distance from a first one of said sides of the housing;

means for electrically connecting first and second contacts of a pair;

each shell having a wider side and a narrower side, the wider side of the shell at said first end of the housing being closest to said top edge of said housing middle, and the wider side of the shell at the second end of the housing being closest to said bottom edge, so one shell appears substantially in the same orientation as the other shell when the housing is rotated 180° about said first imaginary line, said connector forming substantially identical ends but one end being upside-down with respect to the other end;

said means for electrically connecting including a circuit board with a plurality of conductive traces each extending primarily in a direction between the top and bottom edges and connecting the two contacts of a pair.

5. The connector described in claim 4 wherein:

said contacts are arranged in two staggered rows at each end of the connector, including a first row nearest the wider side of the corresponding shell and a second row nearest the narrower side of the same shell;

said circuit board has opposite faces that each face one of said housing ends, and each contact projects substantially from only one face of said circuit board.

6. A gendewr reversal connector comprising:

a housing having a middle and first and second opposite ends, said housing forming two substantially identical shells with one shell at each end, and said housing forming top and bottom edges at said middle and forming opposite housing sides connected by a first imaginary line;

each shell having a wider side and a narrower side, the wider side of the shell at said first end of the housing being closest to said top edge of said housing middle, and the wider side of the shell at the second end of the housing being closest to said bottom edge, so one shell appears substantially in the same orientation as the other shell when the housing is rotated 180° about said first imaginary line, said connector forming substantially identical ends but one end being upside-down with respect to the other end;

a plurality of largely Z-shaped rigid electrically conductive contact devices, each device including first and second elongated substantially parallel ends and a middle integral with said device ends but extending largely perpendicular to them, the middle of each device anchored to said housing middle, the first and second ends of each device projecting respectively into said first and second ends of said housing, each device end being substantially rigid against bending of the end perpendicular to its length, whereby to fix the positions of the device ends.

* * * * *